United States Patent [19]

LaBelle

[11] Patent Number: 4,998,653

[45] Date of Patent: Mar. 12, 1991

[54] BODY-ATTACHABLE, CONCEALABLE POUCH

[76] Inventor: Jeanette M. LaBelle, 5514 Woodmire, Utica, Mich. 48087

[21] Appl. No.: 379,262

[22] Filed: Jul. 13, 1989

[51] Int. Cl.[5] ..... A45C 15/00

[52] U.S. Cl. ..... 224/151; 224/226; 224/229; 224/240; 224/253

[58] Field of Search ..... 224/151, 224, 226, 229, 224/235, 240, 253, 207; 383/83, 122; 150/118, 110; 190/903, 100

[56] References Cited

U.S. PATENT DOCUMENTS

| | | | |
|---|---|---|---|
| D. 89,545 | 3/1933 | Jahncke | 150/118 |
| 906,596 | 12/1908 | Wilson | 224/229 |
| 1,889,389 | 11/1932 | Thornhill | 150/110 |
| 2,474,495 | 6/1949 | Pollak | 224/240 |
| 2,788,040 | 4/1957 | Hullweck . | |
| 2,880,775 | 4/1959 | Beattie | 383/122 |
| 2,925,841 | 2/1960 | Brunner | 383/122 |
| 4,079,767 | 3/1978 | Howard | 224/235 |
| 4,287,971 | 9/1981 | Doulet . | |
| 4,424,841 | 1/1984 | Smith | 224/151 |
| 4,518,107 | 5/1985 | Amos . | |
| 4,545,414 | 10/1985 | Baum . | |

FOREIGN PATENT DOCUMENTS

| | | | |
|---|---|---|---|
| 44466 | 9/1926 | Norway | 224/224 |
| 2158346 | 11/1985 | United Kingdom | 224/229 |

*Primary Examiner*—Linda J. Sholl

*Attorney, Agent, or Firm*—Krass & Young

[57] ABSTRACT

A body-attachable pouch comprises opposed front and back sides joined together along a portion of their perimeters to define a chamber therebetween for receiving articles therein. The pouch includes an opening along the remaining unjoined portion of the perimeter as well as means for closing the opening. A first channel extending substantially parallel to and proximate the longitudinal edge of the pouch and a second channel is disposed perpendicularly to the first channel. An adjustable, removable belt of flexible material is configured to be placed through either of the channels so that the pouch can be worn in various orientations around a wearer.

7 Claims, 1 Drawing Sheet

FIG - 1
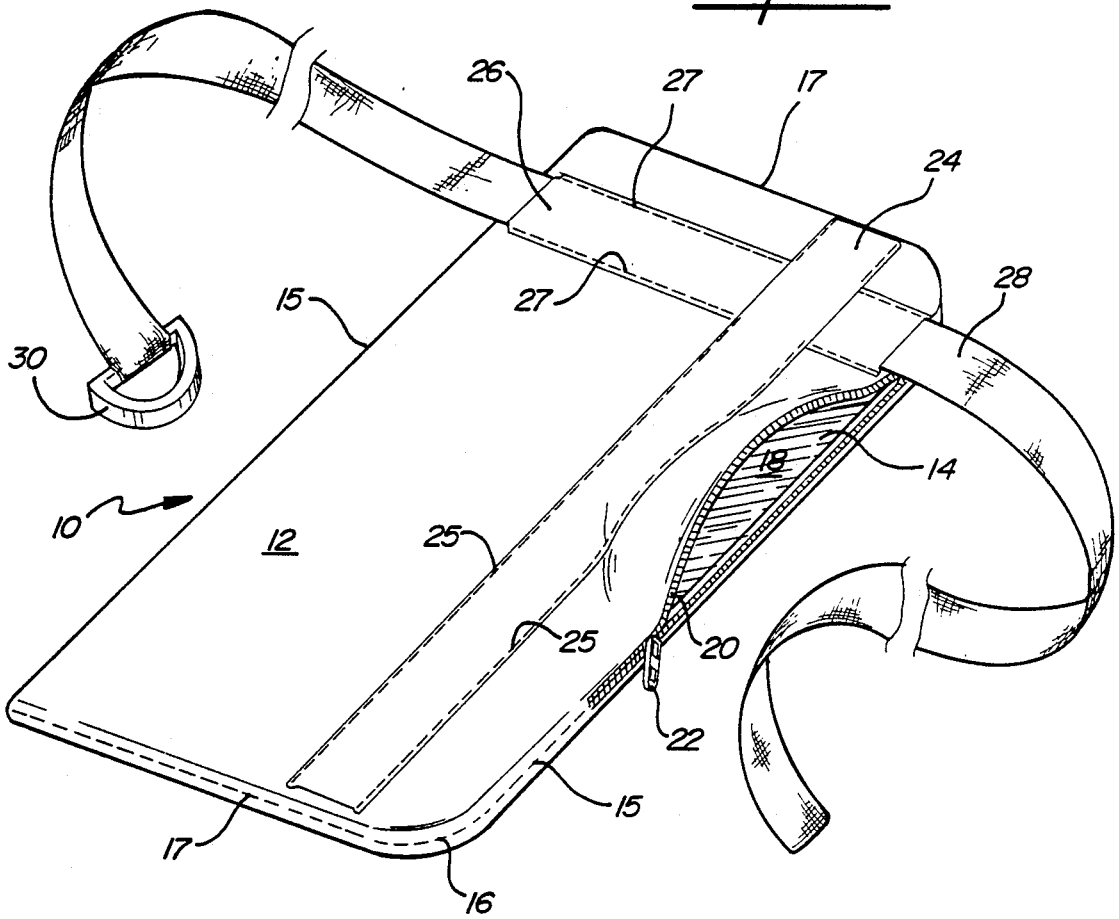
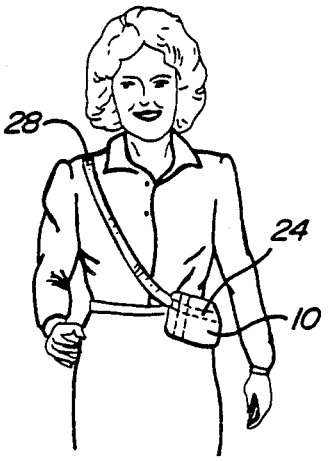
FIG - 2
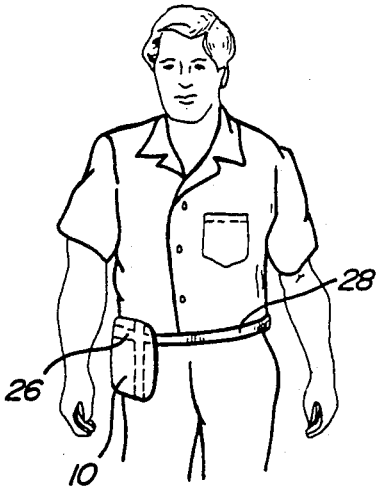
FIG - 3
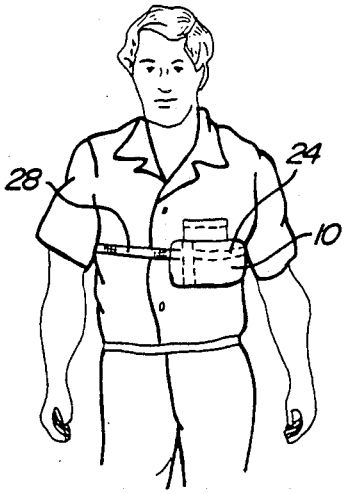
FIG - 4

BODY-ATTACHABLE, CONCEALABLE POUCH

BACKGROUND OF THE INVENTION

1. Field of the Invention

The present invention relates generally to article carriers. More particularly, the present invention relates to a body-attachable pouch for holding articles therein which can be worn in various orientations and is adapted to be concealed under the wearer's clothing.

2. Description of the Related Art

Many different types of article carriers have been proposed for carrying a variety of items. For example, U.S. Pat. No. 4,287,971 discloses an article carrier having two permanently-affixed straps oriented to allow it to be supported either over a wearer's shoulder or around the user's body. U.S. Pat. No. 4,518,107 discloses a ski equipment carrier having one strap that may be supported around the user's torso to carry the bag and other straps that are arrayed over the user's shoulders. The straps are not removable. U.S. Pat. No. 4,545,414 discloses a camera bag having a pair of straps which allow for either torso suspension or shoulder suspension. These carriers are relatively large and bulky and are not adapted to be worn under clothing.

Article carriers have also been proposed for carrying valuable items such as money, credit cards, passports and the like. Typically, these items are carried in either a wallet placed in a pant pocket or in a purse suspended from a shoulder. However, wallets and purses are extremely vulnerable to theft, and for this reason, other carriers have been proposed which are worn on the user's body and concealed the wearer's garments. For example, U.S. Pat. No. 2,788,040 discloses a shoulder-suspended purse adapted to be worn under the wearer's clothing. The strap on the purse is non-removable and the purse may only be worn in one orientation.

There is a need for an article carrier which may be comfortably worn either under or over a person's clothing and which includes a removable strap so that the carrier can comfortably be worn in various orientations around the wearer.

SUMMARY OF THE INVENTION

The present invention provides a pouch for holding articles comprising opposed front and back sides formed of generally rectangular sections of flexible sheet material joined together along a portion of their perimeters to define a chamber therebetween for receiving the articles therein. An opening is defined by the remaining unjoined portion of the perimeters for placing articles therethrough into the chamber.

The invention further includes means for closing the opening, such as a zipper in the preferred embodiment. The pouch further includes first channel means secured to an outer surface of either of the sides and extending substantially parallel to and proximate a longitudinal edge of one of the rectangular sections. A second channel means is also secured to either of the sides and extends generally perpendicularly to the first channel means along a transverse edge of one of the rectangular sections. In the preferred embodiment, each of the channel means is formed of an elongated strip of flexible material secured along each of their respective long edges to the outer surface of one of the sides to define a passage between the strip and the surface for receiving a belt therethrough. Alternatively, a series of belt loops arranged linearly along one of the edges of the pouch may also be used.

The pouch further includes an adjustable, removable belt of flexible material which can be placed through either of the channel means so that the pouch can be worn either adjacent the wearer's body or around the wearer's waist when the belt is placed through the first channel means. The pouch can also be suspended transversely around the wearer's body when the belt is placed through the second channel means.

In the preferred embodiment of the invention, the pouch is adapted to be worn under a wearer's clothing and is formed of a substantially square sheet of flexible material folded generally in half to form the rectangular sections. Each channel is disposed on the same side of the pouch, one extending parallel to the zipper along a longitudinal edge of the pouch, and the other extending transversely across the width of the pouch. Alternatively, one channel may be disposed on one side of the pouch and the other channel disposed on the opposed side of the pouch. The zipper is disposed along a longitudinal edge of the pouch so that the top end of the zipper is proximate the transverse channel at one end of the pouch.

In this manner, the present invention provides a pouch for carrying items underneath a wearer's garments to prevent those items from being easily stolen. The device is inexpensive and easy to manufacture and allows for ready access to the interior of the pouch when the pouch is open. The pouch is comfortable to wear under one's clothing but may also be worn over one's clothing.

These and other advantages of the present invention will be apparent from the drawings, discussion and claims which follow.

BRIEF DESCRIPTION OF THE DRAWINGS

The invention will be more fully understood by reference to the following detailed description and accompanying drawings in which:

FIG. 1 is a perspective view of a pouch for holding articles therein representing the preferred embodiment of the present invention;

FIG. 2 is a perspective view of the pouch of FIG. 1 worn across the torso of a wearer's body;

FIG. 3 is a perspective view of the pouch of FIG. 1 worn around the waist of a wearer's body; and FIG. 4 is another perspective of the pouch of FIG. 1 worn circumferentially around a wearer's body.

DETAILED DESCRIPTION OF THE PREFERRED EMBODIMENT

Referring now to the drawings, as is shown in FIG. 1, pouch 10 comprises a front side 12 and an opposed back side 14 formed of substantially rectangular sections of flexible sheet material. Front side 12 and back side 14 are joined along their perimeters 16 to define a chamber 18 between them for receiving articles such as money, passports and the like therein. Pouch 10 is formed of woven or nonwoven flexible fabric materials and in the preferred embodiment is fabricated from terrycloth, cotton, or other like materials which absorb moisture when pouch 10 is held against the wearer's body.

In the preferred embodiment, pouch 10 is approximately 9.5 inches long along the longitudinal edges 15 and approximately 5 inches wide along the transverse edges 17. This size accommodates a passport easily and is comfortable for a user to wear. Obviously, this size is meant only as an example and not a limitation on the present invention as various other sizes may be utilized as well.

Front side 12 is joined to back side 14 by any of a number of known methods, such as sewing. Alternatively, carrier 10 may be fabricated from a substantially square, single sheet of material folded in half to form substantially identical, rectangular sections which are sewn or otherwise secured together along each transverse edge 17 and along a portion of the unfolded longitudinal edge 15. The remaining unjoined portion of the perimeter defines an opening 20.

As illustrated, the opening 20 is disposed along a longitudinal edge 15 of rectangularly-shaped pouch 10 but may also be formed along a transverse edge. Opening 20 allows easy access to the interior chamber 18 of pouch 10. Means for closing opening 20, such as zipper 22, allows easy and ready access to the interior of pouch 10 and prevents articles in the pouch from falling out. Other suitable closures, such as Velcro® and other separable hook and loop fasteners can be utilized in place of zipper 22. The zipper 22 is secured into opening 20 so that the top end of the zipper 22 is at the same transverse edge of the pouch as the transverse channel 26 which will be more fully described below. In this manner, the zipper 22 will lock in the typical way when fully closed and articles in the pouch will not inadvertently fall out.

Pouch 10 further includes a pair of elongated channels 24,26. As illustrated in FIG. 1, both channels 24,26 are disposed on the same side of pouch 10, but alternatively, each channel may be disposed on opposed sides of pouch 10. Channel 24 extends substantially parallel to and proximate the zipper 22 along a longitudinal edge of carrier 10 and is configured to receive a belt 28 therethrough. Channel 24 may be formed from an elongated strip of flexible material sewn or otherwise secured along its long edges 25 to either side of pouch 10. However, channel 24 is not sewn directly to pouch 10 where channel 24 overlaps channel 26 to ensure that channel 26 remains unobstructed and free to retainably receive a belt 28 therein. Alternatively, channel 24 may include a series of linearly aligned belt loops sewn to either side of pouch 10.

The second channel 26 is disposed perpendicularly to channel 24 proximate a transverse edge of pouch 10. Channel 26 is configured substantially the same as channel 24 in that it also receives belt 28 therethrough as illustrated in FIG. 1. This channel 26 may also be secured to either the front 12 or back side 14 of pouch 10 in any of a number of conventional means. As illustrated, channel 26 is also formed from an elongated strip of flexible material sewn along its long edges 27 to pouch 10. Alternatively, a series of linearly arranged belt loops may be employed in place of the flexible material.

An adjustable, removable belt 28 of flexible material is further provided in the present invention. Belt 28 may be fabricated from a variety of known fabrics and materials including elastic and other synthetic woven materials. Belt 28 is narrower than channels 24 and 26 so that it can be placed through each channel. Belt 28 further includes releasable clasping means, such as dual ring fasteners 30, disposed at one end thereof for securing the belt around the person's body. Other known clasping means may be utilized as well.

By employing the pair of channels 24, 26 in the present invention, pouch 10 can be worn in various orientations around a human body as is shown in FIGS. 2, 3 and 4. As illustrated in all 3 figures, channels 24,26, shown in phantom, are worn against the body so the belt 28 does not prevent the wearer from removing articles from the inside of the pouch. FIG. 2 shows a perspective view of pouch 10 suspended adjacent one hip of a wearer. In this orientation, belt 28 extends diagonally across the wearer's torso and over one shoulder on the opposite side of the hip that the pouch 10 is against. Alternatively, pouch 10 may be suspended diagonally across the wearer's chest when belt 28 is oriented in this manner.

Referring now to FIG. 4, pouch 10 can be worn in a second orientation when belt 28 is placed through longitudinal channel 24. In this orientation, belt 28 extends circumferentially around the wearer's torso and pouch 10 is suspended longitudinally across the wearer's body. The pouch 10 may be worn circumferentially around the wearer's body from just under the arms to around the waist as shown in FIG. 3. Pouch 10 is fabricated from a soft, flexible material so that it can be worn under a person's garments comfortably to conceal valuable items contained therein from possible theft.

FIG. 3 shows a perspective view of pouch 10 worn in another orientation around the wearer's waist. In this orientation, belt 28 is placed through transverse channel 26 and extends circumferentially around the wearer's waist. Pouch 10 suspends transversely from belt 10 adjacent one hip of the wearer. Alternatively, pouch 10 may also be suspended around the wearer's body as described above. In this manner, pouch 10 can be concealed under a pair of pants to conceal items therein from theft.

In light of the foregoing, it should be apparent that many variations are possible within the scope of the present invention. For example, carrier 10 may be fabricated in a variety of shapes out of a variety of different materials, all adapted to be worn either under or over the wearer's clothing. Accordingly, the foregoing drawings, discussion and description are merely meant to be illustrative of particular embodiments of the invention and not limitations upon the practice thereof. It is the following claims, including all equivalents, which define the scope of the invention.

I claim:

1. A pouch for holding articles therein, comprising:

opposed front and back sides formed of flexible sheet material and configured as rectangles having opposed long edges and opposed short edges, said rectangles being joined along both short edges, one of the long edges and a portion of the other of the long edges to define a chamber therebetween for receiving said articles therein, and an opening defined by the remaining unjoined portion of said other of the long edges;

means for closing said opening;

only one adjustable, removable belt of flexible material separate from said closing means;

first channel means secured to an outer surface of either of said sides and extending substantially parallel to and proximate said opening defining a first use position wherein said belt is placed in said first channel means so that said pouch can be suspended adjacent said opening when said belt extends either over the wearer's shoulder and diagonally across the wearer's torso or circumferentially around the wearer's body; and second channel means secured to an outer surface of either of said sides extending generally perpendicularly to said first channel means and proximate one of said short edges defining a second use position, separate from said first use position, wherein said belt is placed in said second channel means so that said pouch can be suspended adjacent said one of the short edges when said belt extends circumferentially around the wearer's body.

2. A pouch as in claim 1, wherein said first and second channel means are each formed of an elongated strip of flexible material secured to either of said sides along both long edges of said strip to define a passage between said strip and said outer surface of said side for receiving said belt therethrough.

3. A pouch as in claim 1, wherein at least one of said channel means includes a plurality of belt loops secured linearly to either of said sides proximate said edges of said sides.

4. A pouch as in claim 1, wherein said first and second channel means are disposed on one side of said pouch.

5. A pouch as in claim 1, wherein one of said channel means is disposed on one side of said pouch and the other of said channel means is disposed on the opposed side of said pouch.

6. A pouch as in claim 1, wherein said belt further includes releasable clasping means for securing the free ends of the belt together.

7. A pouch as in claim 1, wherein said means for closing said opening includes a zipper.

* * * * *